US005288083A

United States Patent [19]

Palmieri

[11] Patent Number: 5,288,083

[45] Date of Patent: Feb. 22, 1994

[54] PADDLE SUSPENDED BALL

[76] Inventor: Herman D. Palmieri, 1532 Ebeb St., Pittsburgh, Pa. 15226

[21] Appl. No.: 954,161

[22] Filed: Sep. 30, 1992

Related U.S. Application Data

[63] Continuation-in-part of Ser. No. 835,703, Feb. 12, 1992, abandoned.

[51] Int. Cl.[5] ..... A63B 67/10

[52] U.S. Cl. ..... 273/329

[58] Field of Search ..... 273/321, 329, 330

[56] References Cited

U.S. PATENT DOCUMENTS

| | | | |
|---|---|---|---|
| 2,105,462 | 1/1938 | Brinkman | 273/329 |
| 2,246,041 | 6/1941 | Halberstauter | 273/329 X |
| 2,967,711 | 1/1961 | Anderson | 273/329 |
| 4,040,623 | 8/1977 | Ott | 273/329 |
| 4,300,771 | 11/1981 | Lori | 273/329 |

FOREIGN PATENT DOCUMENTS

| | | | |
|---|---|---|---|
| 8847 | 9/1906 | Denmark | 273/329 |
| 2321305 | 11/1973 | Fed. Rep. of Germany | 273/329 |
| 743136 | 1/1933 | France | 273/329 |

*Primary Examiner*—William H. Grieb
*Attorney, Agent, or Firm*—Clifford A. Poff

[57] ABSTRACT

A paddle suspended ball, wherein the paddle comprises a handle portion integrally secured to two substantially semi-cylindrical portions ending into parallel arm extensions at the ends of which there is a pivot for suspending a ball by a cord. The length of the cord is such that the ball, when swung in a circular path, will move through the opening defined by said semi-cylindrical portion.

7 Claims, 1 Drawing Sheet

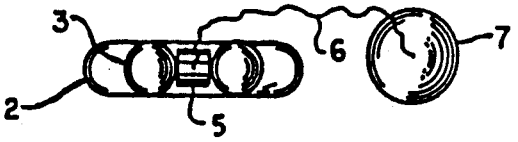
FIG. 1
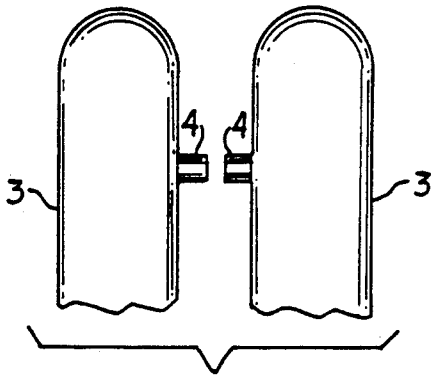
FIG. 6
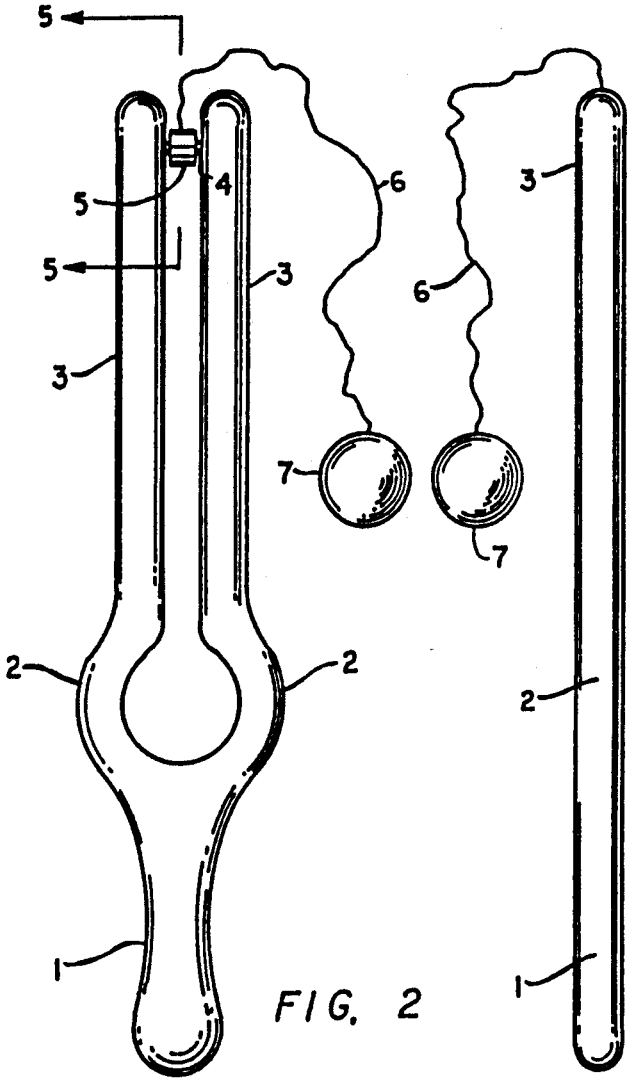
FIG. 2
FIG. 4
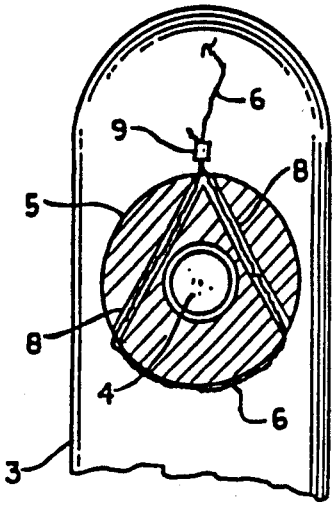
FIG. 5
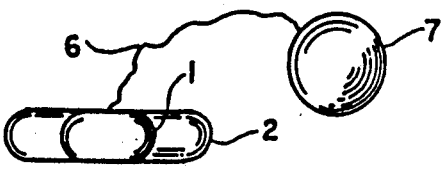
FIG. 3

PADDLE SUSPENDED BALL

CROSS REFERENCED TO RELATED APPLICATION

This patent application is a continuation-in-part of patent application Ser. No. 07/835,703, filed Feb. 12, 1992, now abandoned.

BACKGROUND OF THE INVENTION

1. Field of the Invention

The present invention relates to a play thing, and more particularly to an article of play sometimes referred to in the art as a paddle toy.

2. Description of the Prior Art

Play things of this are shown in U.S. Pat. No. 2,105,462 of Brinkman; U.S. Pat. No. 4,040,623 of Ott; U.S. Pat. No. 4,300,771 of Lori; Danish Patent No. 8,847; German Patent No. 2,321,305; and French Patent No. 743,136. Paddle toys known in the art fail to provide a design that will enable economical construction and reliable use of the toy particularly with respect to the manner by which the free end of the card extending from the ball is attached to allow unrestrained movement about a pivotal support provided by the paddle element of the toy. While a ball has been suspended from a paddle in the past, no means were provided requiring dexterity of the user.

SUMMARY OF THE PRESENT INVENTION

An object of the present invention is to provide a novel paddle suspended ball requiring skill of the user in controlling movement of the suspended ball.

More particularly according to the present invention there is provided a paddle having a handle at one end from which there diverges two semi-circular portions each forming an arm extension extending in a generally parallel relation with one another so that a ball can pass through the semi-circular portions while pivotally swung and held tautly by a length of cord extending from the ball to pass between the parallel arrangement of arm extensions, the improvement comprising a pair of axle portions each carried by one of the arm portions and projecting toward the other from the arm portions in a confronting relationship with one another, a pivot supported by the axial portions for rotatory movement, the pivot including means for receiving the cord extending from the ball to allow tying of the cord to itself externally of the pivot.

BRIEF DESCRIPTION OF THE DRAWINGS

These features and advantages of the present invention as well as others will be more fully understood when the following description is read in light of the accompanying drawings in which:

FIG. 1 is a top view of a paddle suspended ball embodying the present invention;

FIG. 2 is a front view;

FIG. 3 is a bottom view;

FIG. 4 is a side view thereof;

FIG. 5 is an enlarged, fragmentary view, taken along line 5—5 of FIG. 2, showing how the cord is fastened to the cylindrical pivot; and FIG. 6 is an enlarged partial view illustrating the confronting arrangement of axle portions according to the third embodiment of the present invention.

DETAILED DESCRIPTION OF THE PREFERRED EMBODIMENTS

Referring to FIGS. 1, 2, 3 and 4, numeral 1 denotes a paddle made out of plastic, wood or any suitable material, having rounded portions 2,2 providing an inner substantially circular opening for receiving a ball 7. The configuration of the rounded portions 2, 2 may have an inner diameter of 2¼" and an outer diameter of 4". Projecting from the rounded portions 2, 2 are arm extensions 3, 3 each of which may be ⅞" wide and terminate after extending a considerable length as shown in a parallel spaced apart relation. As shown in FIGS. 5 and 6 arm extensions 3, 3 each carry one of a pair of inwardly extending, axle portions 4, 4 which terminate in a confronting relation by the creation of a gap between the terminal ends of the axle portions. The gap between the axle portions allow assembly and removal of the cylindrical pivot 5 that is mounted on the axle portions to freely rotate thereon. The axle portions in the preferred embodiment are an integral part of the arm extensions 3, 3 for reliable manufacturing.

A flexible cord 6 has one end attached to a ball 7 and the other end, as shown more clearly in FIG. 5, extending through groove 8, than through the outer portion of pivot 5, then through another groove 8 and terminates with tie 9 which tightly holds the end of the cord 6. It can be seen further that the grooves 8 are centrally disposed with respect to the extended length of the cylindrical face of pivot 5. As is apparent from FIG. 5, the pivot 5 includes the cord receiving grooves 8 extending internally of the pivot without exposure to the axle portions 4 for holding the end portion of the cord 6 without extending about the entire outer periphery of the axle portions.

In operation, the player holds paddle I and swings ball 7 in a circular path with cord 6 taut and endeavors to have the ball 7 move through the opening defined by rounded portions 2, 2. While cord 6 may be of any desired length, it is preferably to have it of such length that when taut, it will move centrally through the opening defined by rounded portions 2, 2 the greatest number of times in a prescribed number of tries.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. In a paddle having a handle at one end from which there diverges two semi-circular portions each forming an arm extension extending in a generally parallel relation with one another so that a ball can pass through the semi-circular portions while pivotally swung and held tautly by a length of string extending from the ball to pass between the parallel arrangement of arm extensions, the improvement comprising: a pair of axle portions each carried by one of said arm portions and projecting toward the other from said arm portions in a confronting relationship with one another; and a pivot supported by the axle portions for rotatory movement, said pivot including means for receiving the cord extending from said ball to allow tying of the string to itself externally of the pivot, said means for receiving the cord includes a pair of angular extending grooves, one end of said cord being extended through one of said grooves, entrained about the outer portion of a cylindrical pivot and then extended through the other of said grooves to merge from the pivot and allow tying of the end of the cord to a part of the cord immediately adjacent the first entry site by the cord into said grooves.

2. The improvement according to claim 1 wherein said axle portions are each an integral part of the arm portions from which they extend.

3. The improvement according to claim 1 wherein said axle portions are spaced from one another to form a gap therebetween for allowing insertion and removal of said pivot.

4. The improvement according to claim 1 wherein said pivot has a cylindrical outer surface.

5. The improvement according to claim 1 wherein said grooves communicate with said cylindrical outer surface midway across the face length thereof.

6. In a paddle having a handle at one end from which there diverges two semi-circular portions each forming an arm extension extending in a generally parallel relation with one another so that a ball can pass through the semi-circular portions while pivotally swung and held tautly by a length of cord extending from the ball to pass between the parallel arrangement of arm extensions, the improvement comprising: axle means carried by said arm portions and projecting between said arm portions; and, a pivot supported by the axle means for rotatory movement, said pivot including cord receiving means internally of the pivot without exposure to said axial means for holding the end portion of the cord without extending about the entire outer periphery of said axle means.

7. The improvement according to claim 6 wherein said cord extends radially from said means for receiving the cord while rotatably supported by said pivot.

* * * * *